US009581320B2

(12) United States Patent
Ha et al.

(10) Patent No.: US 9,581,320 B2
(45) Date of Patent: Feb. 28, 2017

(54) LIGHTING APPARATUS

(71) Applicant: LG ELECTRONICS INC., Seoul (KR)

(72) Inventors: Jeongseok Ha, Seoul (KR); Jaepyo Hong, Seoul (KR); Hyeuk Chang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 157 days.

(21) Appl. No.: 14/591,725

(22) Filed: Jan. 7, 2015

(65) Prior Publication Data

US 2015/0377473 A1 Dec. 31, 2015

(30) Foreign Application Priority Data

Jun. 25, 2014 (KR) ..... 10-2014-0078000

(51) Int. Cl.

| | |
|---|---|
| ***F21V 29/00*** | (2015.01) |
| ***F21V 29/71*** | (2015.01) |
| ***F21V 29/83*** | (2015.01) |
| ***F21V 29/77*** | (2015.01) |
| ***F21K 99/00*** | (2016.01) |
| ***F21V 29/85*** | (2015.01) |

(Continued)

(52) U.S. Cl.

CPC ..... *F21V 29/713* (2015.01); *F21K 9/00* (2013.01); *F21V 29/74* (2015.01); *F21V 29/77* (2015.01); *F21V 29/83* (2015.01); *F21V 29/85* (2015.01); *F21V 29/745* (2015.01); *F21Y 2101/00* (2013.01); *F21Y 2105/10* (2016.08); *F21Y 2115/10* (2016.08)

(58) Field of Classification Search

CPC ..... F21V 29/713; F21V 29/74; F21V 29/745; F21V 29/77; F21V 29/773; F21V 29/777; F21V 29/83; F21V 29/85; F21V 29/2212; F21K 9/00; F21Y 2105/001; F21Y 2105/10; F21Y 2115/10

See application file for complete search history.

(56) References Cited

U.S. PATENT DOCUMENTS 3,533,270 A * 10/1970 Boudette ..... B21D 53/02 257/E23.086
6,657,862 B2 * 12/2003 Crocker ..... H01L 23/3672 165/121

(Continued)

FOREIGN PATENT DOCUMENTS

JP 2011-108590 A 6/2011
KR 10-2011-0101936 A 9/2011

(Continued)

*Primary Examiner* — Alan Cariaso
(74) *Attorney, Agent, or Firm* — Birch, Stewart, Kolasch & Birch, LLP

(57) ABSTRACT

Provided is a lighting apparatus. The lighting apparatus includes one or more light-emitting modules; a base plate having a bottom surface to which the one or more light-emitting modules are attached; and a heat dissipation fin assembly seated on a top surface of the base plate, wherein the heat dissipation fin assembly includes a plurality of heat dissipation fins which are mounted upright on the top surface of the base plate, wherein each of the heat dissipation fins has a predetermined width in a radial direction from a center of the base plate, and is formed by a thin sheet of a graphite material.

13 Claims, 11 Drawing Sheets

(51) Int. Cl.
*F21V 29/74* (2015.01)
*F21Y 101/00* (2016.01)

(56) References Cited

U.S. PATENT DOCUMENTS

| | | | | |
|---|---|---|---|---|
| 8,444,299 | B2 * | 5/2013 | Chou | F21K 9/135 165/80.3 |
| 8,829,771 | B2 * | 9/2014 | Kang | F21K 9/13 313/46 |
| 8,926,141 | B2 * | 1/2015 | Yeh | F21V 29/262 362/294 |
| 9,033,545 | B2 * | 5/2015 | Barnetson | F21K 9/135 362/249.02 |
| 9,080,755 | B2 * | 7/2015 | Watanabe | F21V 29/004 |
| 9,234,647 | B2 * | 1/2016 | Gabrius | F21S 8/026 |
| 2003/0048608 | A1 | 3/2003 | Crocker et al. | |
| 2010/0132931 | A1 * | 6/2010 | Liaw | F21V 29/004 165/185 |
| 2013/0285529 | A1 * | 10/2013 | Petroski | F21K 9/13 313/46 |
| 2015/0211723 | A1 * | 7/2015 | Athalye | F21V 29/77 362/294 |

FOREIGN PATENT DOCUMENTS

| | | | |
|---|---|---|---|
| KR | 10-2011-0119460 | A | 11/2011 |
| KR | 10-2012-0055718 | A | 5/2012 |

* cited by examiner

LIGHTING APPARATUS

CROSS-REFERENCE TO RELATED APPLICATIONS

The present application claims the benefits of priority to Korean Patent Application No. 10-2014-0078000 filed on Jun. 25, 2014, which is herein incorporated by reference in its entirety.

BACKGROUND

The present disclosure relates to a lighting apparatus.

Lighting apparatuses are electric appliances used for lighting a specific space. Incandescent lamps, discharge lamps, fluorescent lamps, and the like are widely used as light sources for lighting. Resistive light sources such as the incandescent lamps have disadvantages of poor efficiency and much heat generation. On the other hand, the discharge lamps have disadvantages of high price and high voltage. Also, the fluorescent lamps may have environmental problems due to the use of mercury.

To solve the above-described limitations in the light sources according to the related art, there is a growing interest in lighting apparatuses using light emitting diodes (LEDs) that have various advantages in efficiency, color diversity, and design autonomy. Thus, various types of LED lighting apparatus are being released.

Such an LED is a semiconductor device that emits light when a forward voltage is applied. The LED has a long life cycle, low power consumption, and electrical, optical, and physical properties that are suitable for mass production. In recent years, the LEDs are being spotlighted as lighting units that are substituted with the incandescent lamps and the fluorescent lamps.

Also, the LED light sources are being quickly applied to lighting apparatuses such as streetlamps, safety lights, park lights, or security lights.

The LED light sources are required to have a good heat dissipation property because the LED light source generates a lot of heat due to the nature thereof. According to the related art, an aluminum die-casting heatsink is being used. However, the lighting apparatus increases in weight due to a self-weight of the heatsink.

Also, post processing has to be performed on a surface of the aluminum heatsink after the heatsink is formed.

SUMMARY

The present disclosure is suggested to improve the above-described limitations.

Embodiments provide a lighting apparatus including one or more light-emitting modules; a base plate having a bottom surface to which the one or more light-emitting modules are attached; and a heat dissipation fin assembly seated on a top surface of the base plate, wherein the heat dissipation fin assembly includes a plurality of heat dissipation fins which are mounted upright on the top surface of the base plate, wherein each of the heat dissipation fins has a predetermined width in a radial direction from a center of the base plate, and is formed by a thin sheet of a graphite material.

The details of one or more embodiments are set forth in the accompanying drawings and the description below. Other features will be apparent from the description and drawings, and from the claims.

DETAILED DESCRIPTION OF THE EMBODIMENTS

Hereinafter, a lighting apparatus according to embodiments will be described in detail with reference to the accompanying drawings.

Figure 1:
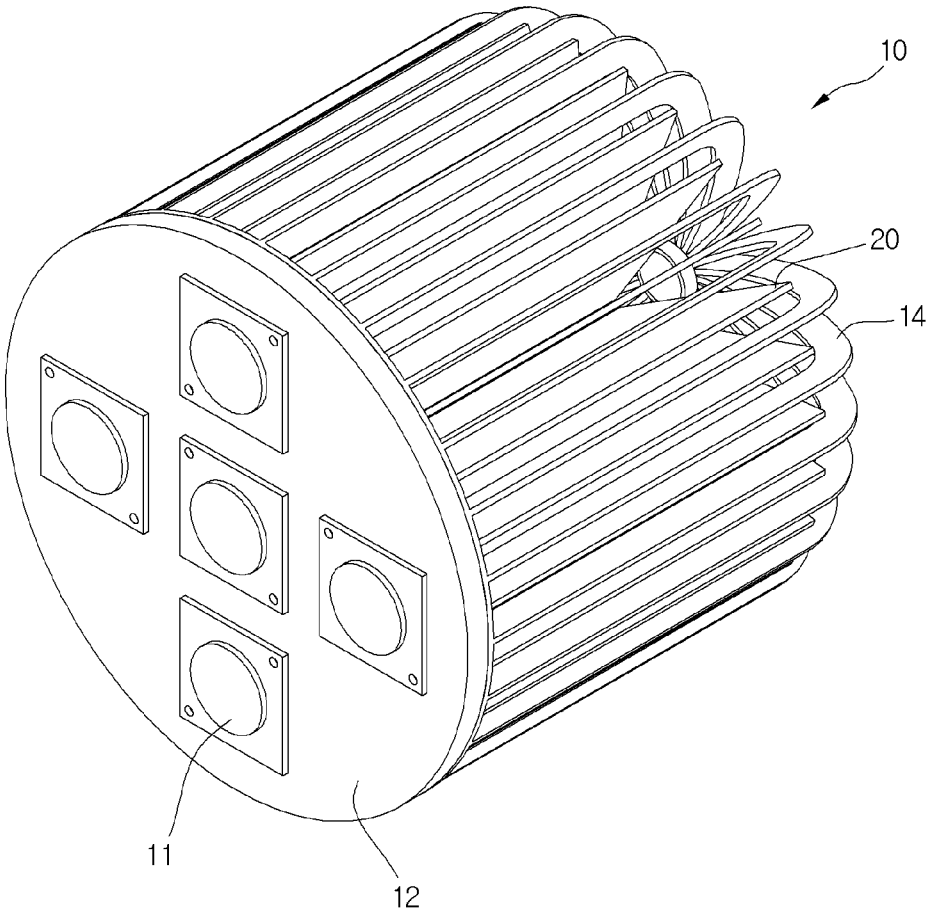
FIG. 1 is a bottom perspective view of a lighting apparatus according to an embodiment.
Figure 2:
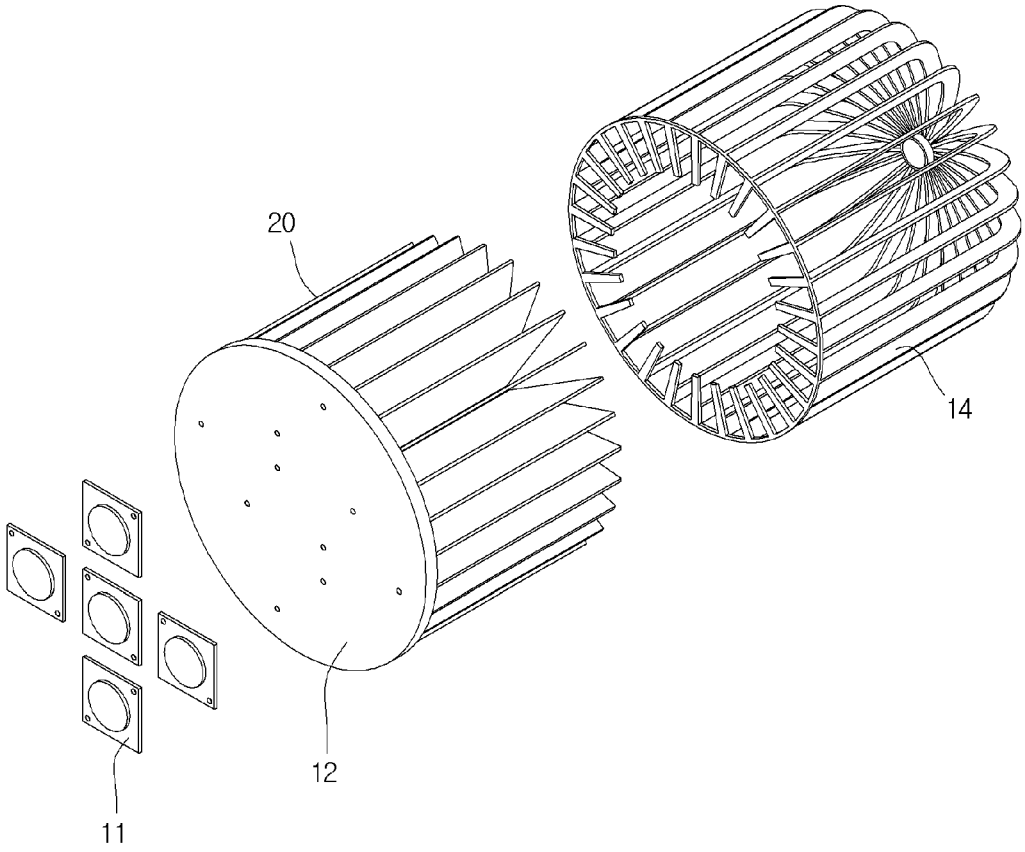
FIG. 2 is an exploded perspective view of the lighting apparatus.

FIG. 1 is a bottom perspective view of a lighting apparatus according to an embodiment, and FIG. 2 is an exploded perspective view of the lighting apparatus.

Referring to FIGS. 1 to 2, the lighting apparatus 10 according to an embodiment of the present disclosure may include an LED module 11, a base plate 12, a heat dissipation fin assembly 20, and a spacer 14.

In detail, at least one LED module 11 may be mounted on a bottom surface of the base plate 12. Also, the LED module 11 may include a chip-on-board type LED module or a surface mounted type LED module.

Also, the base plate 12 may be an aluminum plate with a high heat transfer coefficient so that heat generated from the LED module 12 may be quickly transferred to the heat dissipation fin assembly 20.

Also, the heat dissipation fin assembly 20 is mounted upright on a top surface of the base plate 12 to absorb the heat transferred to the base plate 12 by heat conduction. Also, air passing through the heat dissipation fin assembly 20 is heat-exchanged with the heat dissipation fin assembly 20 by the heat conduction. Thus, the heat dissipation fin assembly 20 functions as a heatsink which discharges the heat conducted from the base plate 12 to the air.

Also, the spacer 14 is attached on the top surface of the base plate 12 to prevent the heat dissipation fin assembly 20 from being bent or broken by an external shock or a contact force. Further, the spacer 14 also functions as an auxiliary heatsink which absorbs the heat conducted from the base plate 12 to discharge the heat to the air. Accordingly, the spacer may be formed of a metal material with a high heat transfer coefficient.

Figure 3:
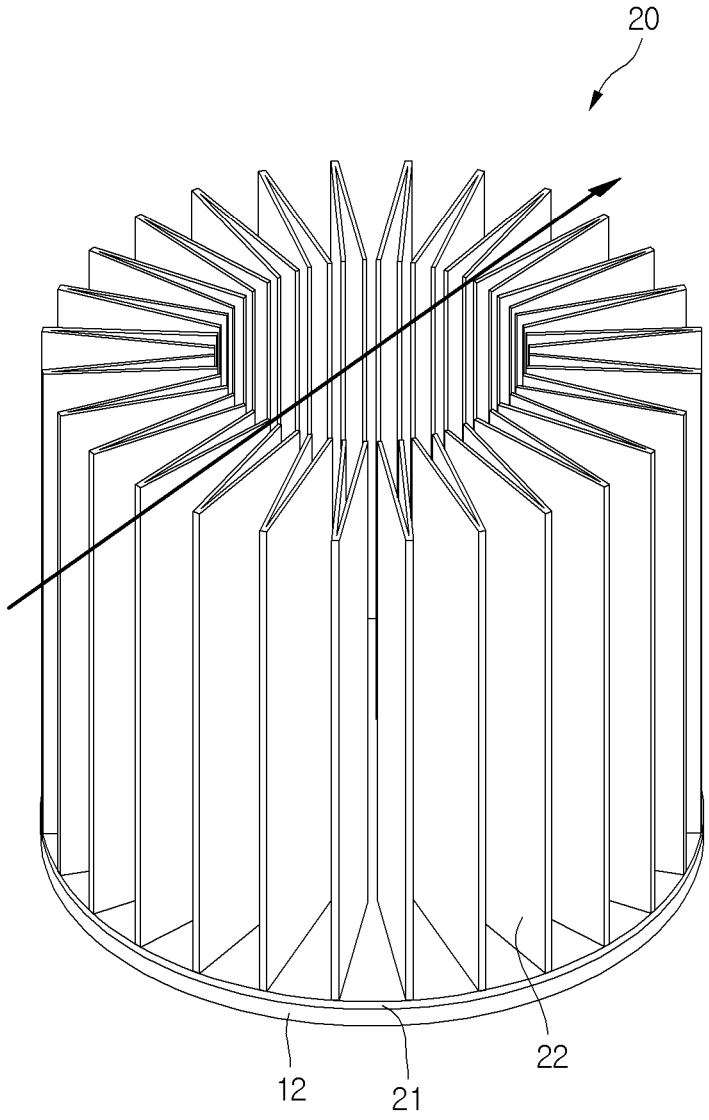
FIG. 3 is a perspective view of a heat dissipation fin assembly constituting the lighting apparatus according to an embodiment.
Figure 4:
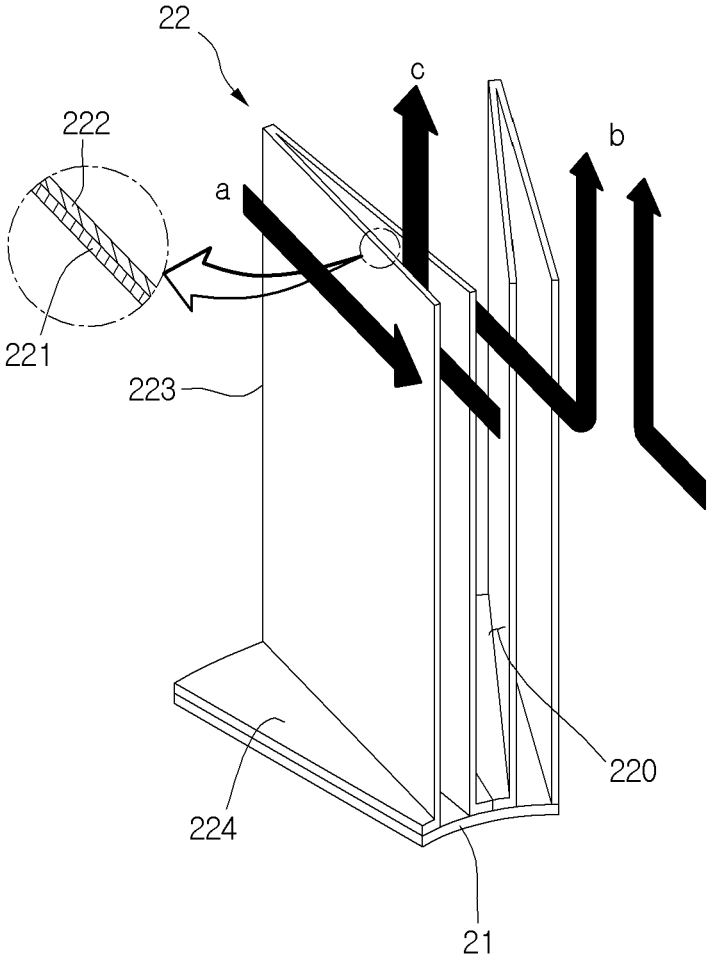
FIG. 4 is a perspective view illustrating a structure of a heat dissipation fin constituting the heat dissipation fin assembly.

FIG. 3 is a perspective view of a heat dissipation fin assembly constituting the lighting apparatus according to an embodiment, and FIG. 4 is a perspective view illustrating a structure of a heat dissipation fin constituting the heat dissipation fin assembly.

Referring to FIGS. 3 and 4, the heat dissipation fin assembly 20 constituting the lighting apparatus 10 according to an embodiment of the present disclosure includes a heat dissipation plate 21 placed on a top surface of the base plate 12 and a plurality of heat dissipation fins 22 which are disposed upright on a top surface of the heat dissipation plate 21.

In detail, the multiple heat dissipation fins 22 may be directly attached to the base plate 12 without the heat dissipation plate 21 as well as attached to the top surface of the heat dissipation plate 21.

Also, each of the plurality of heat dissipation fins 22 extends by a predetermined length from the center of the heat dissipation plate 21 toward a radial direction. Here, the extending length in the radial direction may be defined as a width of the heat dissipation fin 22. Also, each of the heat dissipation fins 22 may extend upward by a predetermined length and have a bent structure so that a lateral section thereof may have a V-shape. That is, the heat dissipation fin 22 may be mounted in such a way that a line passing through a bent part 223 thereof may cross the heat dissipation plate 21 at right angles.

Also, the plurality of heat dissipation fins 22 each of which has a V-shaped lateral section may be arranged to be spaced by a predetermined distance apart from each other in a circumferential direction of the heat dissipation plate 21. Here, the heat dissipation fin 22 may be disposed in such a way that the bent part 223 is placed on an outer edge of the heat dissipation plate 21, and both ends of the heat dissipation fin 22 are placed at a center side of the heat dissipation plate 21. Alternatively, the bent part 223 is placed at the center side of the heat dissipation plate 21 and both ends of the heat dissipation fin 22 are placed on the outer edge of the heat dissipation plate 21. In the current embodiment, a structure, in which the bent part 223 is placed on the outer edge of the heat dissipation plate 21, will be described as an example.

The heat dissipation fin 22 may have a sheet shape in which an aluminum sheet 221 is coupled to a graphite sheet 222 by using an adhesive. Also, the heat dissipation fin 22 may be disposed in such a way that the graphite sheet 222 defines an inner circumferential surface of the heat dissipation fin assembly 20, and the aluminum sheet 221 defines an outer circumferential surface of the heat dissipation fin assembly 20. However, the present disclosure is not limited thereto. For example, the graphite sheet 222 may define the outer circumferential surface of the heat dissipation fin assembly 20.

Also, the heat dissipation fin 22 may be formed of the graphite sheet 222 only. That is, the heat dissipation fin 22 may be formed of the graphite sheet 222 only and be supported by the spacer 14 so as not to be bent.

In the current embodiment, the heat dissipation fin 22 may be formed of the graphite sheet 222 and the aluminum sheet 221, and the graphite sheet 222 may define the inner circumferential surface of the heat dissipation fin assembly 20.

A lower portion of the heat dissipation fin 22 may be bent in a wing-shape to extend so as to define an adhesion part 224. That is, the adhesion part 224 defines a portion of the heat dissipation fin 22. The adhesion part 224 is attached to the top surface of the heat dissipation plate 21 so that the adhesion part 224 allows the heat dissipation fin 22 to be stably fixed onto the heat dissipation plate 21. However, the lower portion of the heat dissipation fin 22 may be directly attached to the heat dissipation plate 21 without being bent.

Heat dissipation property of the heat dissipation fin assembly 20 that has the above-mentioned structure will be described below. First, when the lighting apparatus 10 is installed so that the LED module 11 faces the ground, the air is introduced from a lateral side toward the center of the lighting apparatus 10 as illustrated with arrow a of FIG. 4. That is, the air is introduced between the heat dissipation fins 22 adjacent to each other, and the introduced air is concentrated to the center of the heat dissipation fin assembly 20 through an air-vent hole 220 defined between the heat dissipation fins 22 adjacent to each other.

Also, a portion of the air concentrated to the center from the lateral side of the heat dissipation fin assembly 20 flows upward as illustrated with arrow b, and the rest of the air is introduced inside a heat dissipation fin 22 disposed at an opposite side to flow toward the bent part 223 of the opposite heat dissipation fin 22.

Also, as illustrated with arrow c, the air flowing toward the bent part 223 of the heat dissipation fin 22 flows upward and is discharged outside the heat dissipation fin assembly 20. The air (arrow a) introduced from the outside of the heat dissipation fin assembly 20 is heat-exchanged with the aluminum sheet 221 of the heat dissipation fin 22. The air (arrow c) flowing from the center of the heat dissipation fin assembly toward the radial direction is heat-exchanged with the graphite sheet 222 of the heat dissipation fin 22.

Figure 5:
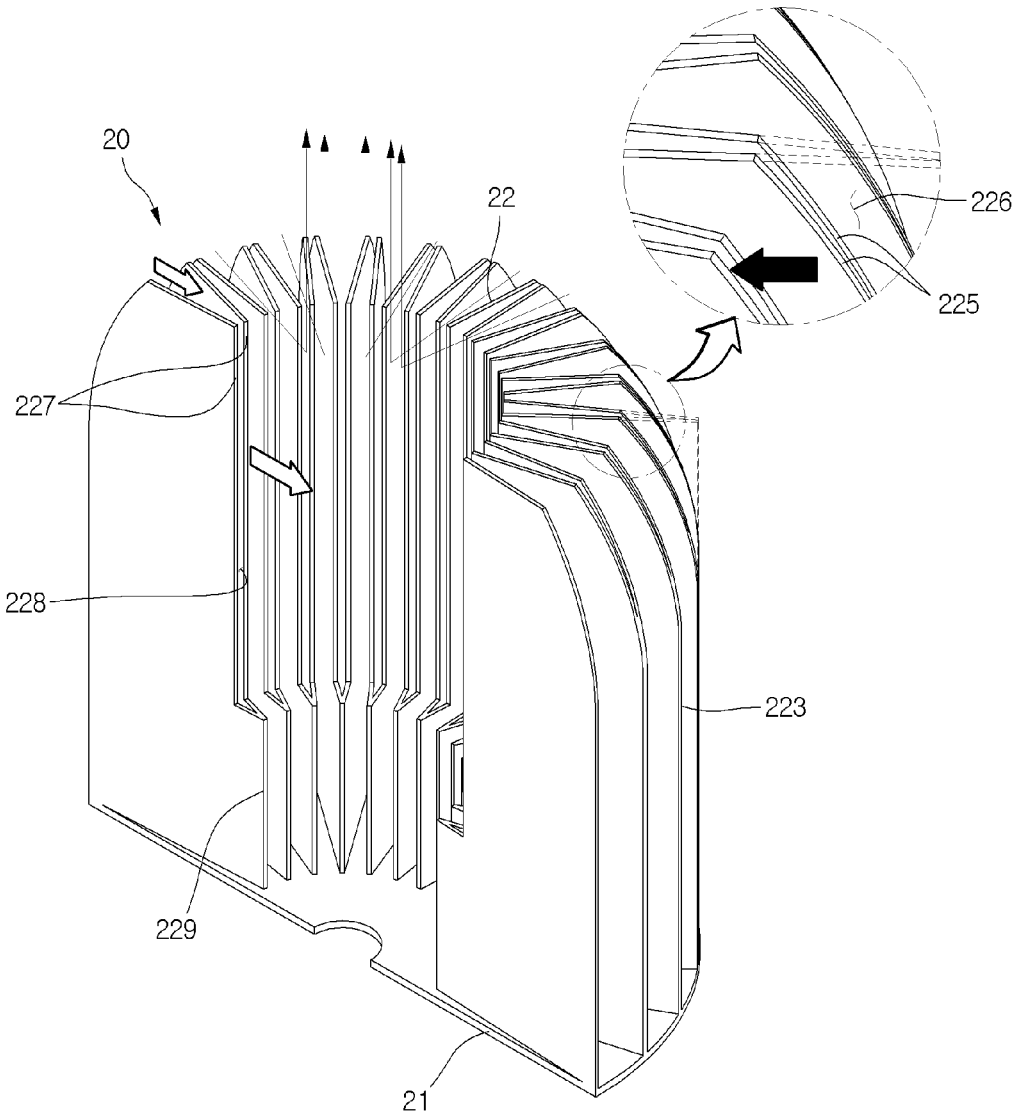
FIG. 5 is a longitudinal cross-sectional cut-away perspective view illustrating a structure of a heat dissipation fin assembly according to another embodiment.

FIG. 5 is a longitudinal cross-section perspective view illustrating a structure of a heat dissipation fin assembly according to another embodiment.

Referring to FIG. 5, a heat dissipation fin assembly according to the current embodiment, unlike the previous embodiments in which the plurality of heat dissipation fins each of which is bent in a V-shape are disposed adjacent to each other, has a structure in which one long heat dissipation fin is bent several times in a zigzag shape to extend along a circumferential direction of the heat dissipation plate 21 on the top surface of the heat dissipation plate 21.

In this structure, the heat dissipation fin 22 may be stably attached to the heat dissipation plate 21 without falling down even when the heat dissipation fin 22 is not attached to the bottom part of the heat dissipation plate 21 by using a separate adhesion part 224.

In the case of the heat dissipation fin assembly 20 described in the current embodiment, it is necessary to make an air flow path because the air may not flow from an outer lateral side of the heat dissipation fin assembly 20 toward an inner center of the heat dissipation fin assembly 20.

In detail, an edge part, where an upper end of the heat dissipation fin assembly 20 meets the bent part 223 of the heat dissipation fin assembly 20, is cut to define an outer air-vent hole 226. The cutoff surface may be defined as an outer cutoff part 225. That is, the edge part is cut, and air-vent hole the outer cutoff parts 225 of two heat dissipation fins 22 connected with respect to the bent part 223 are spaced apart from each other to define the outer cutoff parts 225.

Each of the outer cutoff parts 225 may have a smoothly-rounded cutoff line as illustrated or have a straight-cutoff line. Also, in the current embodiment, the bent part 223 may be defined as an outer bent part.

Also, since the heat dissipation fin assembly 20 has a structure in which a sheet of the heat dissipation fin is bent several times in a zigzag shape, an inner bent part 229 is alternately defined with the bent part 223 which is defined as the outer bent part. Also, a portion of the inner bent part 229 has to be cut so as to allow the air introduced from the outer lateral side into the heat dissipation fin assembly 20 through the outer air-vent hole 226 to communicate with a center part of the heat dissipation fin assembly 20.

In detail, air-vent hole an inner air-vent hole 228 cut from an upper end of the inner bent part 229 to a bottom end of the inner bent part 229 is defined so that the inner air-vent hole 228 has a predetermined length and width. The cutoff surface may be defined as inner cutoff parts 227. The inner cutoff parts 227, which is defined by cut a portion of the inner bent part 229, are spaced by a predetermined distance apart from each other to define the inner air-vent hole 228.

According to this structure, the external air introduced through the outer air-vent hole 226 is concentrated to the center of the heat dissipation fin assembly 20 through the inner air-vent hole 228. Also, the air, which is concentrated to the center of the heat dissipation fin assembly 20, is reduced in density while heat-exchanges with the heat dissipation fin 22 to form an ascending air flow. This is the same as the previous embodiment.

When the inner cutoff parts 227 defined in one inner cutoff part 229 are spaced apart from each other, boundary layers of the air ascending along a surface of the heat dissipation fin at a cutoff part side are less likely to overlap each other. As a result, a turbulent flow layer is formed in an upper end area of the heat dissipation fin assembly 20 or in an area lower than the upper end area, i.e., in an inner area of the heat dissipation fin assembly 20. In this case, the heat dissipation fin 22 may contact the air for a long time to increase heat-exchange efficiency.

When the boundary layers of the ascending air flow overlap each other, long boundary layers are formed in an ascending direction of the air. As a result, a turbulent flow layer is formed in an area higher than the upper end area of the heat dissipation fin assembly 20, i.e., outside the heat dissipation fin assembly 20. In this case, the heat dissipation fin 22 may contact the air for a short time to decrease heat-exchange efficiency.

Figure 6:
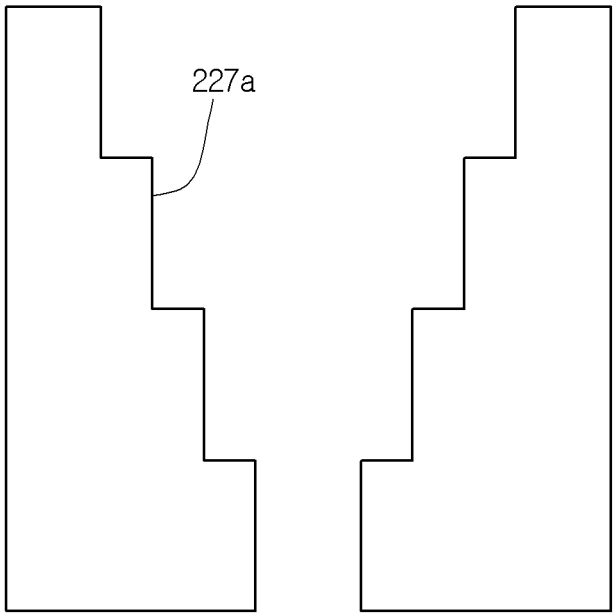
FIGS. 6 to 8 are schematic views illustrating various embodiments of a shape of an inner cutoff part of a heat dissipation fin.
Figure 7:
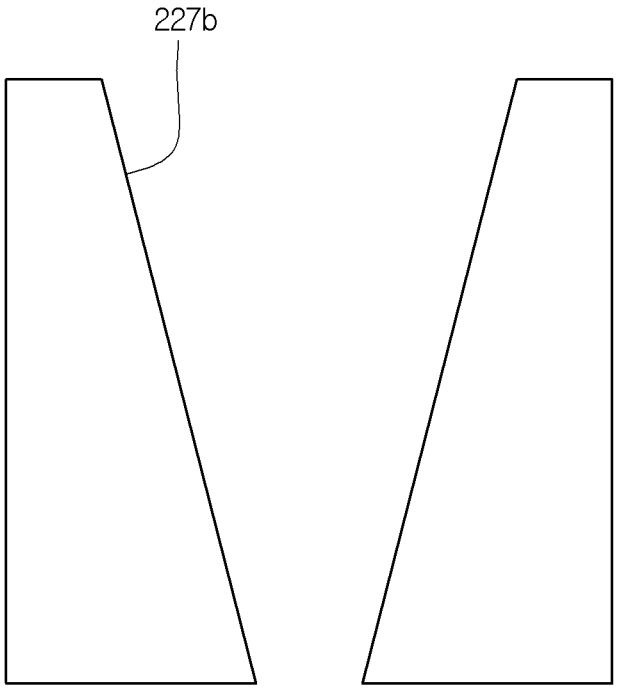
Figure 8:
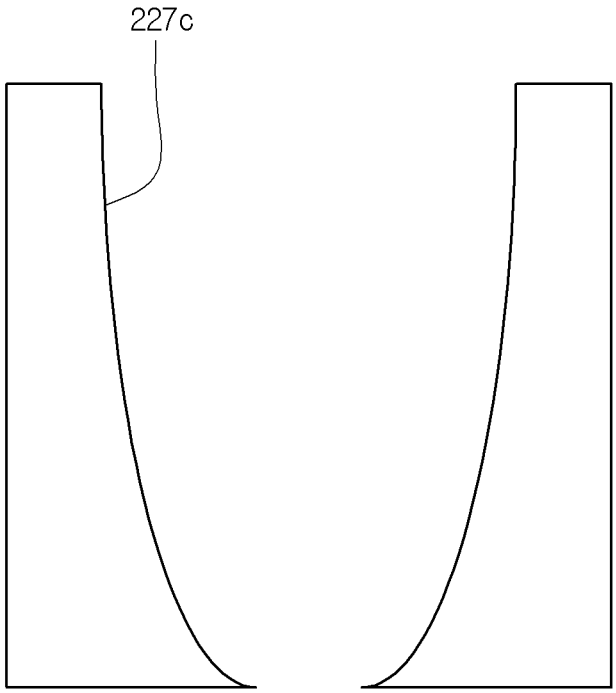

FIGS. 6 to 8 are schematic views illustrating various embodiments of a shape of an inner cutoff part of the heat dissipation fin.

Referring to FIG. 6, although the inner cutoff part 227 is stepped once in the embodiment of FIG. 5, an inner cutoff part 227*a* is defined in a multi-stepped shape in the current embodiment.

Referring to FIG. 7, an inner cutoff part 227*b* may be inclined at a predetermined angle.

Referring to FIG. 8, an inner cutoff part 227*c* may be rounded in a parabolic shape.

A common point of the inner cutoff parts 227, 227*a*, 227*b*, and 227*c* illustrated in FIGS. 5 to 8 is that the inner cutoff parts 227, 227*a*, 227*b*, and 227*c* are cut in a direction in which the gap between the inner cutoff parts facing each other gradually increases from the lower end of the heat dissipation fin 22 toward the upper end of the heat dissipation fin 22.

In detail, since the inner cutoff parts are defined as illustrated, a flow direction of the heat-exchanged air, that is, air density decreases in the central portion of the heat dissipation fin 20 to gradually expand an area of a flow space of the air toward the ascending direction of the air. According to this structure, the boundary layers of the ascending air flowing along the surfaces of the inner cutoff parts may be gradually less likely to overlap each other as. As a result, a turbulent flow layer may be formed in an upper central end area of the heat dissipation fin assembly 20 or in the area lower than the upper central end area. In this case, the heat dissipation fin 22 may contact the air for a long time to increase heat-exchange efficiency.

Figure 9:
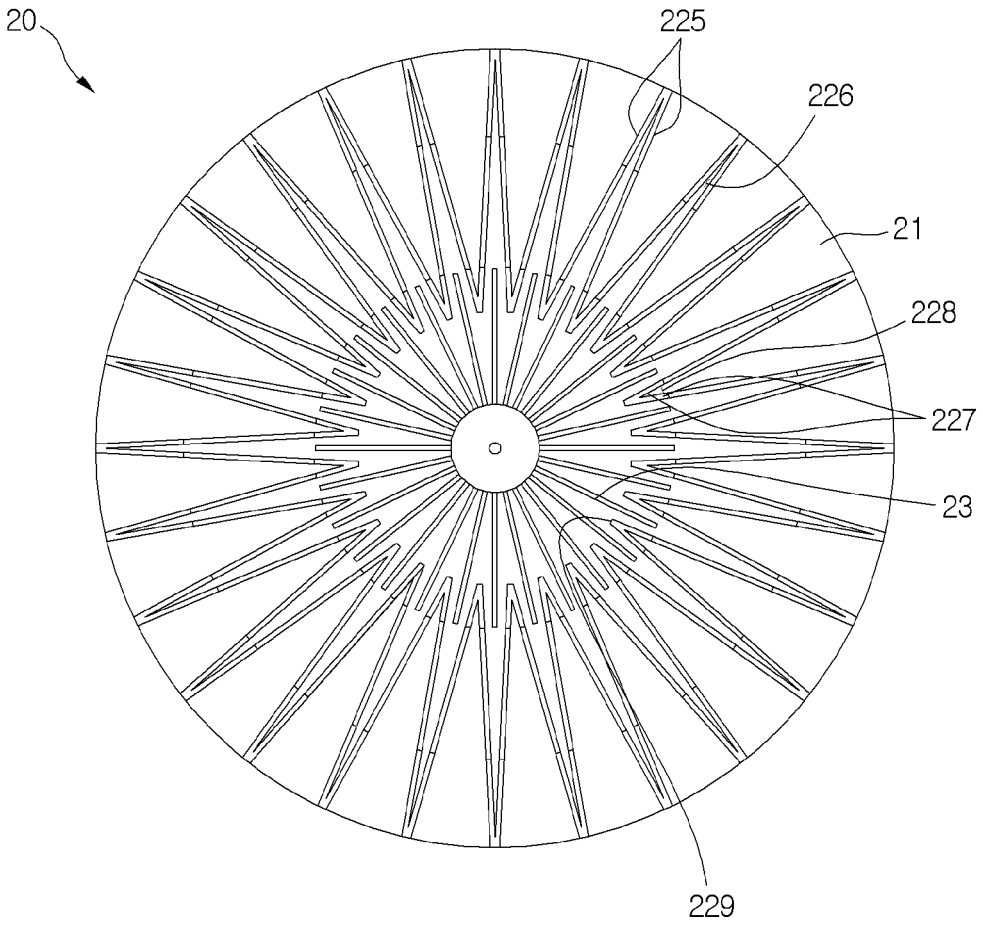
FIG. 9 is a plan view of a heat dissipation fin assembly according to another embodiment.
Figure 10:
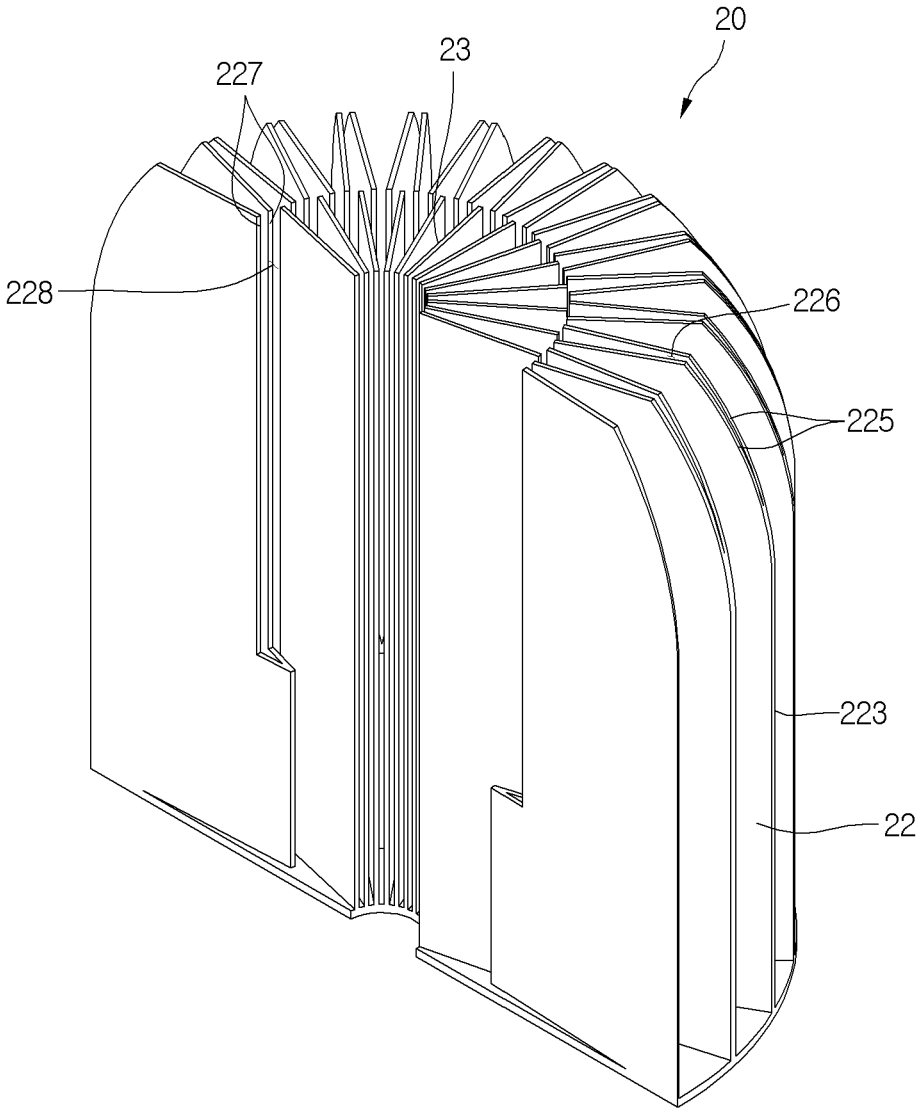
FIG. 10 is a longitudinal cross-sectional cut-away perspective view illustrating a heat dissipation fin assembly.

FIG. 9 is a plan view of a heat dissipation fin assembly according to another embodiment, and FIG. 10 is a longitudinal cross-sectional cut-away perspective view of the heat dissipation fin assembly.

Referring to FIGS. 9 and 10, the heat dissipation fin assembly 20 according to the current embodiment has the same structure as that of the heat dissipation fin assembly 20 of FIG. 5 except for that an inner fin 23 is additionally disposed inside the heat dissipation fin assembly 20.

In detail, the inner fin 23 may have a predetermined length and be mounted upright on the heat dissipation plate 21. Also, the inner fin 23 may have a rectangular plate shape extending by a predetermined width from the center of the heat dissipation plate 21 in a radial direction.

Also, the inner fin 23 may extend between inner bent parts 229 adjacent to each other of the heat dissipation fin assembly 20. Also, the inner pin 23 is formed of the same material as the heat dissipation fin 22 and functions as an auxiliary dissipation fin.

Figure 11:
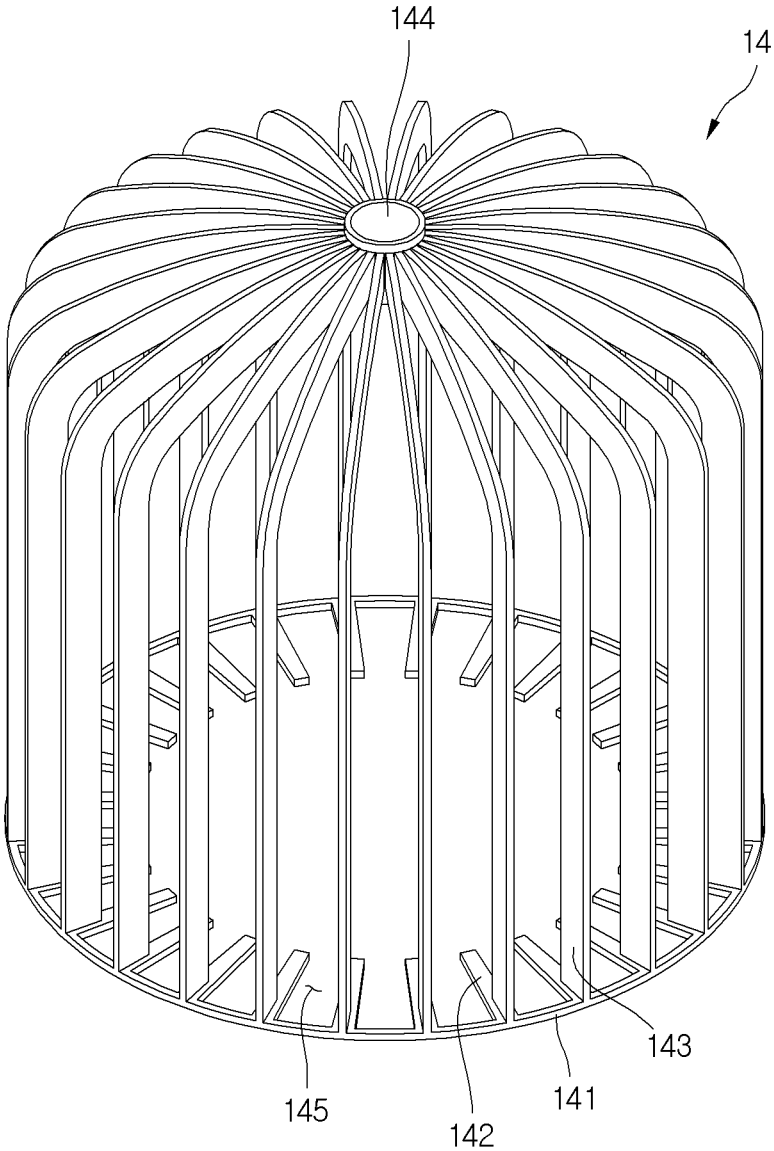
FIG. 11 is a perspective view of a spacer constituting the lighting apparatus according to an embodiment.

FIG. 11 is a perspective view illustrating a spacer constituting the lighting apparatus according to an embodiment.

Referring to FIG. 11, the spacer 14 may be formed of a metal material with a certain level of stiffness to prevent the heat dissipation fin assembly 20 from being deformed or broken by the external shock. Also, the spacer 14 may be formed of an aluminum material to function as a heatsink.

The spacer 14 may include a frame part 141, a plurality of horizontal ribs 142, a plurality of vertical ribs 143, and a center part 144.

In detail, the frame part 141 may have the same shape and size as a curvature radius of the base plate 12 or the heat dissipation plate 21. The frame part 141 may have a band shape having a predetermined width. Also, the frame part 141 is fixed onto the top surface of the base plate 12 or on the top surface of the heat dissipation plate 21.

In other words, when the heat dissipation fin assembly 20 does not include a separate heat dissipation plate 21, the frame part 141 may directly contact the top surface of the base plate 12. When the heat dissipation fin assembly 20 includes a separate heat dissipation plate 21, the frame part 141 may directly contact the top surface of the heat dissipation plate 21.

Also, each of the horizontal ribs 142 may extend in a predetermined length from an inner edge of the frame part 141 toward the center of the frame part 141. Here, the horizontal ribs 142 adjacent to each other may be spaced a predetermined distance apart from each other. Also, spaces defined between the horizontal ribs 142 adjacent to each other may be defined as a heat dissipation fin accommodation groove 145. That is, each of the heat dissipation fins 22 is accommodated in the accommodating groove 145.

Also, each of the plurality of vertical ribs 143 may have a predetermined width and extend upward from each of the top surfaces of the plurality of horizontal ribs 142. Also, top ends of the vertical ribs 143 are bent toward the center part 144.

In detail, the center part 144 is a part to which the top ends of the vertical ribs are concentrated. The top ends of the vertical ribs. 143 may be combined in one point to maintain shapes of the vertical ribs 143 without being bent the vertical ribs 143.

The lighting apparatus according to the embodiments of the present disclosure, the graphite sheet may be used as the heat dissipation unit to significantly increase heat dissipation efficiency in comparison with the aluminum sheet.

Also, since the thin graphite sheet is adopted, the heat dissipation fin may be reduced in load to significantly decrease the total load of the lighting apparatus.

Also, the heat dissipation sheet using the graphite sheet may have the simple structure to decrease manufacturing time and costs.

Also, since the thin aluminum sheet is attached onto the one surface of the graphite sheet, the thin graphite sheet may be improved in ductility.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

one or more light-emitting diode (LED) modules;

a base plate having a bottom surface to which the one or more light-emitting diode modules are attached; and a heat dissipation fin assembly including a plurality of heat dissipation fins, the heat dissipation fin assembly being seated on a top surface of the base plate and formed by a thin sheet of a graphite material;

wherein the heat dissipation fin assembly has a structure in which a sheet of heat dissipation fin plate is bent several times in a zigzag shape to have a plurality of bent parts, and is disposed in a circumferential direction on the top surface of the base plate, wherein the heat dissipation fin assembly is defined as an assembly of a plurality of fin parts which are partitioned by the plurality of bent parts, wherein the plurality of bent parts comprise:

a plurality of inner bent parts disposed inside the base plate; and a plurality of outer bent parts disposed on an outer edge of the base plate and alternately disposed with the plurality of inner bent parts in the circumferential direction of the base plate, and wherein the heat dissipation fin assembly has:

an inner air-vent hole defined by cutting at least a portion of each of the plurality of inner bent parts; and an outer air-vent hole defined by cutting at least a portion of each of the plurality of outer bent parts.

2. The lighting apparatus according to claim 1, wherein inner cutoff parts defining the inner air-vent hole are stepped once or several times so that an inner upper end of the heat dissipation fin is farther away from a central portion of the heat dissipation fin assembly than an inner lower end of the heat dissipation fin is away from the central portion of the heat dissipation fin assembly.

3. The lighting apparatus according to claim 1, wherein inner cutoff parts defining the inner air-vent hole are inclined or rounded so that an inner upper end of the heat dissipation fin is farther away from a central portion of the heat dissipation fin assembly than an inner lower end of the heat dissipation fin is away from a central portion of the heat dissipation fin assembly.

4. The lighting apparatus according to claim 2, further comprising a plurality of inner fins disposed inside the heat dissipation fin assembly, wherein each of the plurality of inner fins is mounted upright on the top surface of the base plate and has a predetermined width in a radial direction from the center of the base plate, and an outer end of each of the plurality of inner fins is disposed between the bent parts adjacent to each other.

5. The lighting apparatus according to claim 3, further comprising a plurality of inner fins disposed inside the heat dissipation fin assembly, wherein each of the plurality of inner fins is mounted upright on the top surface of the base plate and has a predetermined width in a radial direction from the center of the base plate, and an outer end of each of the plurality of inner fins is disposed between the bent parts adjacent to each other.

6. The lighting apparatus according to claim 1, wherein the heat dissipation fin assembly further comprises a heat dissipation plate to which a lower end of each of the plurality of heat dissipation fins is attached, wherein the heat dissipation plate is seated on the top surface of the base plate.

7. The lighting apparatus according to claim 6, further comprising a spacer seated on a top surface of the heat dissipation plate.

8. The lighting apparatus according to claim 7, wherein the spacer comprises:

a frame part having a predetermined width, the frame part being disposed along an edge of the top surface of the base plate or the heat dissipation plate;

a plurality of horizontal ribs extending from an inner edge of the frame part toward a center of the frame part;

a plurality of vertical ribs extending upward from top surfaces of the plurality of horizontal ribs; and a center part to which upper ends of the plurality of vertical ribs are concentrated.

9. The lighting apparatus according to claim 8, wherein the plurality of horizontal ribs are spaced a predetermined distance apart from each other in a circumferential direction to define a plurality of heat dissipation fin accommodation grooves, wherein the plurality of heat dissipation fins are accommodated in the plurality of accommodation grooves, respectively.

10. The lighting apparatus according to claim 1, further comprising a spacer seated on the top surface of the base plate.

11. The lighting apparatus according to claim 10, wherein the spacer comprises:

a frame part having a predetermined width, the frame part being disposed along an edge of the top surface of the base plate or the heat dissipation plate;

a plurality of horizontal ribs extending from an inner edge of the frame part toward a center of the frame part;

a plurality of vertical ribs extending upward from top surfaces of the plurality of horizontal ribs; and a center part to which upper ends of the plurality of vertical ribs are concentrated.

12. The lighting apparatus according to claim 11, wherein the plurality of horizontal ribs are spaced a predetermined distance apart from each other in a circumferential direction to define a plurality of heat dissipation fin accommodation grooves, wherein the plurality of heat dissipation fins are accommodated in the plurality of accommodation grooves, respectively.

13. The lighting apparatus according to claim 1, further comprising an aluminum sheet attached to the plurality of heat dissipation fins, wherein the aluminum sheet defines an outer surface of the heat dissipation fin assembly, and the graphite sheet defines an inner surface of the heat dissipation fin assembly.

* * * * *